United States Patent [19]

Murdock

[11] 4,002,396

[45] Jan. 11, 1977

[54] ELECTRIC CONNECTOR APPARATUS

[75] Inventor: Robert E. Murdock, Atlanta, Ga.

[73] Assignee: Kearney-National Inc., Atlanta, Ga.

[22] Filed: Feb. 13, 1976

[21] Appl. No.: 657,856

[52] U.S. Cl. ..... 339/111

[51] Int. Cl.[2] ..... H01R 13/52

[58] Field of Search ..... 339/111

[56] References Cited

UNITED STATES PATENTS

| | | | |
|---|---|---|---|
| 3,617,987 | 11/1971 | Sankey | 339/111 |
| 3,713,077 | 1/1973 | Leonard | 339/111 |
| 3,860,322 | 1/1975 | Sankey et al. | 339/111 |
| 3,917,374 | 11/1975 | Murdock | 339/111 |
| 3,951,507 | 4/1976 | Lambert | 339/111 |
| 3,955,874 | 5/1976 | Boliver | 339/111 |

*Primary Examiner*—Roy Lake
*Assistant Examiner*—Howard N. Goldberg
*Attorney, Agent, or Firm*—Walter M. Rodgers; Walter A. Rodgers

[57] ABSTRACT

An electric terminal such as a transformer bushing having a contact socket of conducting material is provided with a quench tube arranged in aligned substantially coaxial relation with the contact socket. An associated connector which may be of the elbow type is provided with a contact pin which includes a tubular element of conducting material having an end of reduced diameter on which a hollow sleeve is disposed thereabout and formed of strong plastic material having an enlarged end nose portion of the same or of a different plastic material together with a sleeve of arc extinguishing material which is disposed about the plastic sleeve and arranged with one end in snug engagement with the enlarged end portion which is bevelled at its outer end to facilitate entry of the contact pin into and through the quench tube and into the contact socket so as to form a connection between the contact socket and the tubular element of conducting material.

7 Claims, 4 Drawing Figures

ELECTRIC CONNECTOR APPARATUS

The nose portion of known arc pins which cooperate with known quench tubes associated with electric bushings are formed of highly efficient arc extinguishing material. Difficulties encountered in connection with elements formed of certain arc extinguishing materials are usually due to mechanical brittleness of the arcc extinguishing material. Since connector apparatus is frequently subjected to heavy duty rough usage, elements formed of highly proficient arc extinguishing materials frequently are chipped or broken and hence rendered useless under many service conditions.

Plastic materials are known which are very strong mechanically and which are well adapted to withstand a high degree of mechanical stress. Unfortunately such strong materials are not well suited for use as arc extinguishing materials.

U.S. Pat. No. 3,917,374 issued November 4, 1975 and U.S. Pat. application Ser. No. 574,918 filed May 6, 1975 now U.S. Pat. No. 3,951,507 issued Apr. 30, 1976 disclose and claim contact pins which are formed of combinations of strong plastic material and of highly proficient arc extinguishing material.

According to the present invention, advantage is taken of the highly proficient arc extinguishing characteristics of known arc extinguishing materials and also of known mechanically strong plastic materials and such materials are combined in such a way that compensation for the brittle characteristics of known proficient arc extinguishing materials is achieved by use of a mechanically strong plastic material which is not required to perform an arc extinguishing function. More specifically and according to the invention, one end of a contact pin is provided with a contact stem which is formed of mechanically strong metal and coaxially disposed with respect to the contact pin, and a nose piece is secured to the inner end of the stem, while an insulating sleeve is disposed about the contact stem, and an outer sleeve of arc extinguishing material is disposed about the insulating sleeve and between the inner end of the contact pin and the enlarged nose piece whose inner end is bevelled to facilitate entry into the quench tube. This arrangement affords manufacturing advantages in that each part can be fabricated and then assembled to form the complete unit using simple and specialized techniques. Also maintenance and repair are facilitated because replacement of one or more parts frequently fully restores the connector.

Figure 1:
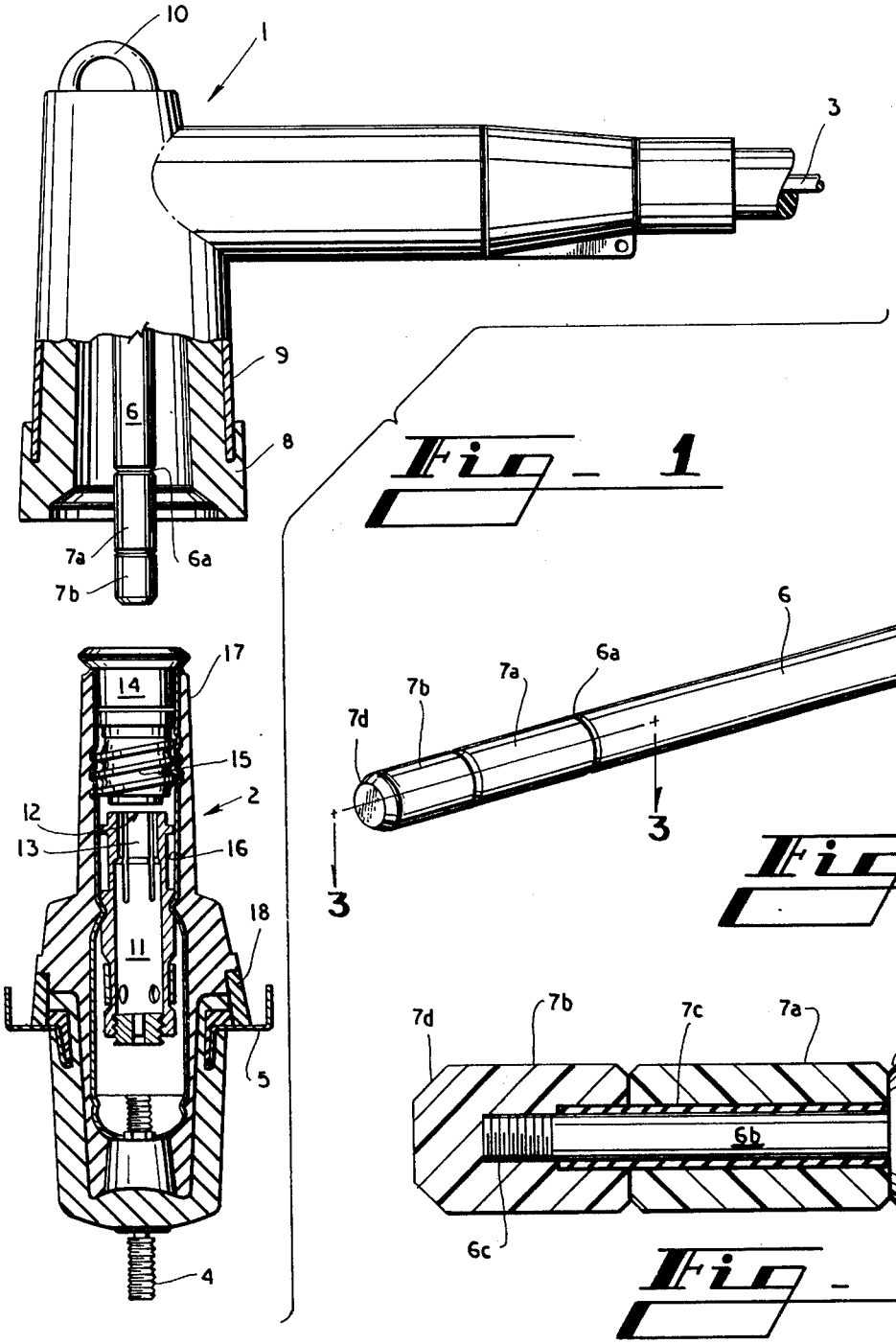
Figure 2:
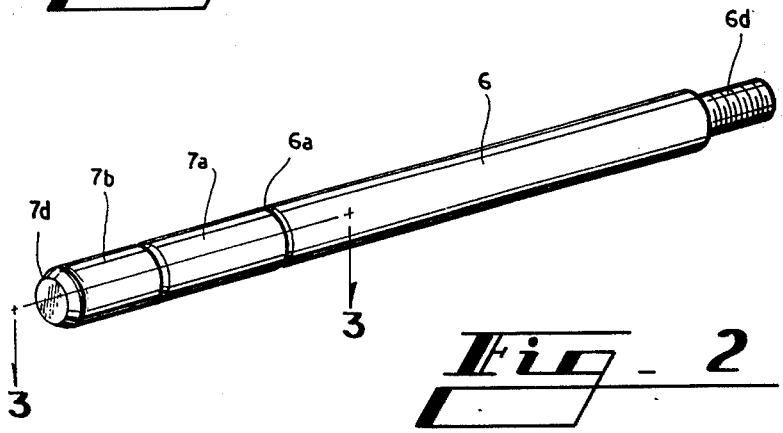
Figure 3:
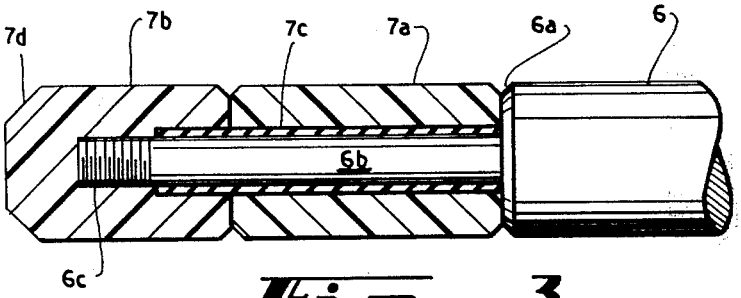
Figure 4:
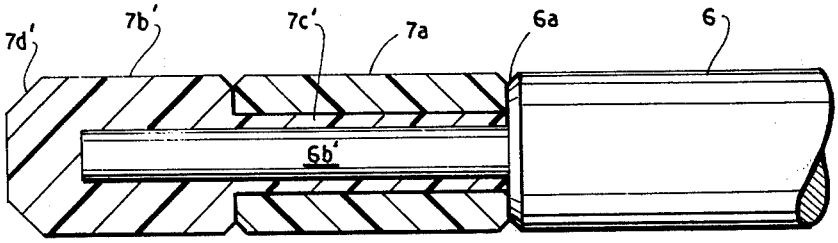

For a better understanding of the invention, reference may be had to the following detailed description taken in conjunction with the accompanying drawings in which FIG. 1 is a view partially in section of a bushing connector and associated quench tube together with an elbow type connector with the parts shown in an open circuit position for clarity; FIG. 2 is a perspective view of a contact pin constructed according to the invention; FIG. 3 is a view partially in section taken along the line designated 3—3 in FIG. 2; and in which FIG. 4 is a view similar to FIG. 3 but which depicts a modification of the invention.

With reference to FIG. 1, the numeral 1 generally designates an elbow connector of conventional construction while the numeral 2 generally designates a bushing connector of conventional construction and which cooperates with the elbow connector 1 to form a connection between an outside conductor such as is designated by the numeral 3 and electric apparatus which may constitute a transformer winding, one terminal of which is designated by the numeral 4, the bushing 2 being mounted within an aperture formed in the transformer casing (not shown) and supported therein by suitable known support ring 5.

The elbow connector 1 comprises a contact pin having a rod-like or tubular conducting part 6 and a coaxially arranged part 7*a* formed of arc extinguishing material and a nose piece 7*b* of strong plastic material all of which are cylindrically configured together with insulating housing structure 8 about which is disposed elastomeric conducting material 9. A hook 10 is arranged to receive an end of a clamp stick by which the connector 1 is manipulated.

The bushing connector 2 comprises a contact socket 11 the upper end 12 of which is open. Slots are formed in the sides of contact socket 11 to define a plurality of fingers 13 so as to render the upper end of the contact socket expandable for receiving the contact pin 6, 7*a*, 7*b*.

The quench tube 14 is provided with exterior threads 15 which cooperate with internal threads formed within the support structure comprising inner metallic conductive sleeve 16 which is received within a cavity formed within insulating housing support 17. Insulating housing support 17 is provided with elastomeric conducting material 18 which is grounded to bracket 5 and in turn to the tank of the associated apparatus such as a transformer.

In order to complete a circuit between conductors 3 and 4, the elbow connector 1 is manipulated in such a manner as to cause the skirt 8 to envelope the housing support structure 17 and so to cause the arc extinguishing part 7*a* to pass through the quench tube 14 and downwardly into the contact socket 11. Of course when the lower end 6*a* of the conducting tube 6 enters the open end of contact socket 11 and engages the contact fingers 13, the circuit is complete.

When the connector 1 is withdrawn, an arc is established between the end portion 6*a* of conducting portion 6 of the contact pin as the lower end 6*a* clears the upper end 12 of the contact socket 11. The arc is extinguished by arc extinguishing portion 7*a* of the contact pin and by the quench tube 14.

The quench tube 14 is formed of arc extinguishing material which is very effective in extinguishing electric arcs.

The contact pin shown in FIGS. 2 and 3 is constructed according to the invention and comprises a tubular conducting part 6 from the inner end 6*a* of which a strong metal stem 6*b* extends. The stem 6*b* is an extension of the conducting part 6 of the contact pin and may be formed of the same or of different conducting material. The diameter of stem 6 *b* is substantially smaller than the diameter of conducting part 6. If stem 6*b* is formed of a different material than pin 6, the stem may be threaded into pin 6 or could be secured in an axial aperture by means of a pressed fit or by other means. Disposed about the stem 6*b* is a sleeve 7*c* formed of heat and shrink insulating material or of some other suitable insulating material such as varnish. A preformed cylinder of suitable plastic or other insulating material could be used as part 7*c* if desired. Disposed about sleeve 7*c* is a sleeve 7*a* of arc extinguishing material the outer diameter of which is substantially equal to the diameter of the tubular conducting part 6. Since arc extinguishing material is mechanically brittle, and because the nose piece 7*b* is mechanically strong but formed of insulating material which is not particularly effective as an arc extinguishing material, the result is a mechanically strong highly effective arc extinguishing structure. According to one aspect of the invention, the inner end of nose piece 7b is bevelled as indicated at 7d to facilitate entry of nose piece 7b into quench tube 14 and contact socket 11. If desired the inner end of nose piece 7b could be suitably rounded. The threaded end 6c of stem 6b forms a secure junction with nose piece 7b. The threaded end 6d of conducting tubular structure 6 is threaded into a suitable conductor such as a contact block as disclosed and claimed in U.S. Pat. No. 3,768,065 granted Oct. 23, 1973.

In FIG. 4 the sleeve 7c' is integral with nose piece 7b' and these parts are secured via suitable adhesive or a pressed fit to stem 6b' which is not threaded. If desired sleeve 7c' and nose piece 7d' could be molded around stem 6b'.

From the above description, it is apparent that by the invention a contact pin is constructed in such manner as to take advantage of the arc extinguishing properties of the brittle sleeve such as 7a and advantage is also taken of the strong mechanical properties of the plastic nose piece such as 7b and the strength of metal stem 6b and 6b'. Also by forming the unit of parts as described, manufacture and maintenance procedures are facilitated.

The embodiments of the invention in which an exclusive property or privilege is claimed are defined as follows:

1. A contact pin constituting a component of an electric connector apparatus, said contact pin comprising a tubular conducting part of conducting material having a coaxial stem of conducting material projecting from the end of said tubular conducting part which is subjected to arcing, said stem being of substantially smaller diameter than said conducting part, a hollow tubular sleeve of brittle arc extinguishing material disposed about said stem and in coaxial relation therewith and having one end in snug engagement with the adjacent end of said tubular conducting part of conducting material which is subjected to arcing, the outer diameter of said hollow tubular sleeve being substantially equal to the diameter of said tubular conducting part, and a separate nose piece formed of mechanically strong insulating material and secured to said stem in coaxial relation therewith and having a part in engagement with the other end of said sleeve, the outer end of said nose piece being bevelled externally.

2. A contact pin according to claim 1 wherein said stem is integrally formed with said tubular conducting part and of the same material.

3. A contact pin according to claim 1 wherein said stem is formed of different conducting material than said tubular conducting part.

4. A contact pin constituting a component of an electric connector apparatus, said contact pin comprising a tubular pin of conducting material having a coaxial stem projecting from the end of said tubular pin which is subjected to arcing, a hollow tubular sleeve of arc extinguishing material disposed about said stem and in coaxial relation therewith and having one end in snug engagement with the adjacent end of said tubular pin of conducting material which is subjected to arcing, a nose piece formed of mechanically strong insulating material secured to said stem in coaxial relation therewith and having a part in engagement with the other end of said sleeve, and a sleeve of insulating material interposed between said sleeve of arc extinguishing material and said stem.

5. A contact pin according to claim 4 wherein said sleeve of insulating material is interposed between said stem and a part of said nose piece.

6. A contact pin according to claim 5 wherein said nose piece is threadedly secured to said stem.

7. A contact pin according to claim 4 wherein said sleeve of insulating material and said nose piece are integral with each other and are formed of the same material.

* * * * *